US005782373A

United States Patent [19]

Bianchi

[11] Patent Number: 5,782,373

[45] Date of Patent: Jul. 21, 1998

[54] METAL CONTAINER WITH MEANS FOR ALLOWING A RAPID EMPTYING OF THE CONTAINER

[76] Inventor: Luca Bianchi, Piazza Italia, 9, Lissone MI, Italy, I-20035

[21] Appl. No.: 758,972

[22] Filed: Dec. 2, 1996

Related U.S. Application Data

[63] Continuation of Ser. No. 446,678, filed as PCT/EP94/03181 Sep. 23, 1994 published as WO95/09775 Apr. 13, 1995.

[30] Foreign Application Priority Data

Oct. 5, 1993 [IT] Italy ..... MI930766 U

[51] Int. Cl.[6] ..... B65D 17/34

[52] U.S. Cl. ..... 220/269; 220/271; 220/745; 220/906; 222/482

[58] Field of Search ..... 220/269, 270, 220/271, 729, 745, 601, 906; 215/378; 222/482

[56] References Cited

U.S. PATENT DOCUMENTS

| | | | |
|---|---|---|---|
| 297,174 | 4/1884 | Seymour | 215/378 |
| 581,814 | 5/1897 | Durkin et al. | 215/378 |
| 842,652 | 1/1907 | Hamilton | 215/378 |
| 2,238,821 | 4/1941 | Peppers . | |
| 3,071,281 | 1/1963 | Sawai | 220/916 X |
| 3,355,058 | 11/1967 | Asbury | 220/269 |
| 4,163,517 | 8/1979 | Kappler et al. | 220/916 X |
| 4,252,247 | 2/1981 | Asbury | 220/268 |
| 4,624,386 | 11/1986 | Grigorenko et al. | 220/269 |
| 4,883,198 | 11/1989 | Manska | 222/1 |
| 4,923,098 | 5/1990 | Schoonover et al. | 222/482 X |
| 4,976,367 | 12/1990 | Hoefler | 220/260 |
| 5,123,461 | 6/1992 | Belokin, Jr. et al. | 220/916 X |
| 5,201,437 | 4/1993 | Burgdorf | 220/601 |
| 5,285,919 | 2/1994 | Recchia | 220/271 |

FOREIGN PATENT DOCUMENTS

| | | | |
|---|---|---|---|
| 4-57745 | 2/1992 | Japan | 220/906 |
| WO 93/12006 | 12/1992 | WIPO . | |

*Primary Examiner*—Stephen Cronin
*Attorney, Agent, or Firm*—Collard & Roe, P.C.

[57] ABSTRACT

A disposable, metal beverage can having a easy-opening tab on the top of the can. A second easy-opening tab is disposed on the can generally opposite the first easy-opening tab. The second tab is located on the bottom of the can or on the side of the can near the bottom. The first tab is opened to pour out the beverage by raising the bottom above the top. The second tab is then opened so that air enters the can above the beverage for rapid and regular emptying of the can while avoiding splashing of the beverage during pouring.

1 Claim, 1 Drawing Sheet

METAL CONTAINER WITH MEANS FOR ALLOWING A RAPID EMPTYING OF THE CONTAINER

This is a continuation of copending application Ser. No. 08/446,678, filed as PCT/EP94/03181 Sep. 23, 1994 published as WO95/09775 apr. 13, 1995.

BACKGROUND OF THE INVENTION

1. Field of the Invention

The invention relates to a metal container for carbonated or natural beverages, provided with manually-operated tabs to allow a quick and regular emptying of the fluid contained therein.

2. The Prior Art

As is known, cylindrical cans or the like are made from metal, in particular aluminum, and contain either carbonated beverages, such as ale, orangeade, Coca-Cola and the like, or natural fluids. These cans are provided on the sealed lid with means for quick opening by hand, i.e. without the utilization of tools or the like. Such devices consist of a tag suitable to be lifted and pulled away from the lid, which removes from said lid a zone previously treated (by a partial cut or the like), so as to circumscribe, after the removal, an opening wide enough to allow distribution of the content. These "pull tabs" are positioned to remove a zone of the lid near the edge, in order to constitute a mouth suitable to make pouring the fluid easy, without too much spilling of the fluid late rally to the mouth.

In practice, the emptying of a usual can through a distribution mouth, whose area is necessarily limited, is always difficult and above all irregular, especially at the beginning of the distribution, both when the fluid is poured into another container or directly into the mouth of the consumer. This is due to the fact that, when the can is tilted or overturned, the fluid coming out occupies the entire mouth opening, and therefore does not let air enter the can. As a result, atmospheric pressure on the fluid which is obviously necessary to allow a correct distribution is not available. Therefore, the fluid comes out irregularly and to adjust the outflow it is necessary to frequently change the angle of the can to reduce the outflow and to let air in, on the fluid contained in the can.

In practice, this involves a decrease in the emptying velocity of the can and undesirable oscillations and/or rebounds of the fluid during the distribution, which also causes the fluid to spill around the distribution mouth of said can.

SUMMARY OF THE INVENTION

An object of this invention is therefore to provide a metal container for carbonated or natural beverages, with suitable means to obviate the drawbacks of the present beverage cans with pull opening or the like, with no need for important structural changes in the traditional cans.

Another object of this invention is to provide a can of the aforementioned type, which allows a quick and regular emptying without involving irreparable fluid spillage and losses; on the lid and the sides of the can.

A further object of this invention is to provide a metal can capable of quick and regular emptying, so designed as not to constitute undesirable encumbrances and as to be efficacious and reliable, besides being cost efficient.

These and still other objects which will be more clearly stressed in the following, are achieved by a metal can for carbonated or natural beverages, provided with a pull opening or the like. The container is a common cylindrical can or the like, provided on the sealed lid with a pull tag or the like for the opening of the can and, at the opposite end of said can, with hand-operated means suitable to realize a second opening at the moment of emptying. Both openings, opposite one another, allow, after the removal of the pull tag provided on the lid and with the can upright, to tilt the can to the distribution position and to operate thereafter the tab for the second opening to let air in on the fluid, causing in this way a quick and regular emptying of the can, without rebounds or oscillations of the fluid during the distribution.

More particularly, the second opening is located on the bottom of the can, according to one of the possible embodiments. According to another embodiment, said second opening is positioned on the cylindrical surface of the can, near the bottom of same.

The second opening may include a pull tag or pre-cut zone in the cylindrical wall or in the bottom, removable by exercising pressure on same with a finger, a bar-shaped tool, or by other analogous pressure means.

BRIEF DESCRIPTIONS OF THE DRAWINGS

Further characteristics and advantages of this invention shall appear more clearly from the following detailed description, made with reference to the attached drawings, given by way of example, wherein.

DETAILED DESCRIPTION OF THE PREFERRED EMBODIMENT

Figure 1:
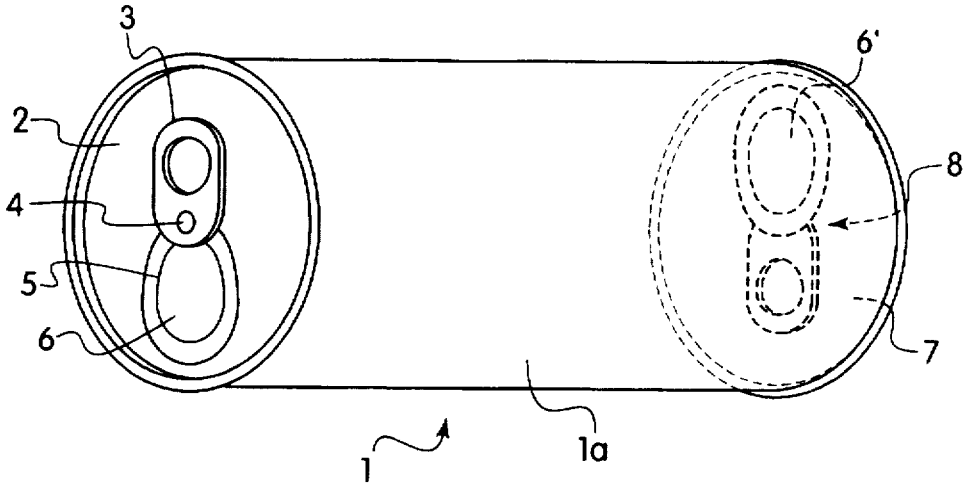
FIG. 1 is a schematic drawing of a can for ale, orangeade or the like, according to a first practical embodiment of the invention.

With special reference to FIG. 1, the can-shaped container according to the invention is a common cylindrical metal can 1, generally from aluminum or its alloys, and normally provided on lid 2 with a usual pull tag 3, hooked at 4 to an oval zone 5 precut on lid 2. By lifting tag 3, one removes the peripherally precut zone 5, leaving on the lid an opening corresponding to the removed zone 6. Opening 6 constitutes the distribution mouth of the can.

Figure 2:
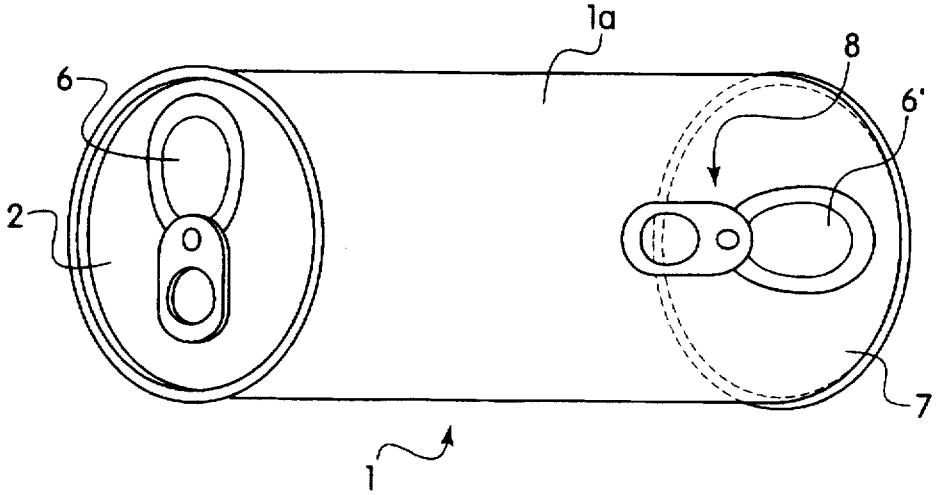
FIG. 2 is a schematic view of a can according to another embodiment.

The invention consists, according to the embodiment shown in FIG. 1, in providing on bottom 7 of said can an analogous opening 6', realized by means of a pull tag 8. This pull tag 8 may also be realized on the cylindrical wall of can 1, in a position as near as possible to bottom 7 of said can as shown in FIG. 2.

Figure 3:
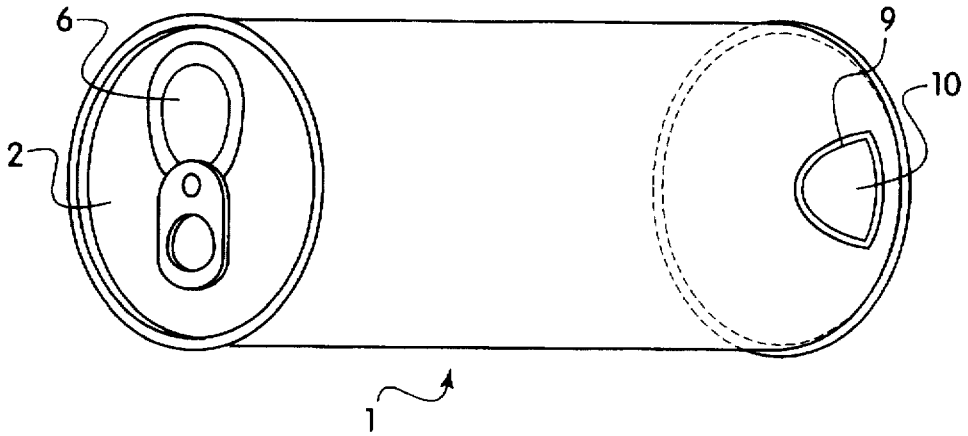
FIG. 3 is a schematic view of a can according to a further embodiment.

According to another embodiment, the opening opposite the distribution opening 6 may be realized either on bottom 7 or on the cylindrical wall la of the can, by prearranging a partial cut or deformation 9 across area 10 in FIG. 3, having a round, oval or polygonal width and shape. Area 10 can be wholly removed or partly bent towards the inside of the can, at the moment of distribution of the fluid, by pressure exercised on zone 10 by a finger, the end of a pencil or any other suitable and convenient means. In this way, an opening is created opposite distribution opening 6.

According to the invention, it does not matter whether opening 10 or 6', on bottom 7 or near the same, has an area similar, greater or small (for instance by half) than the area of the distribution mouth 6. Said opening 10 or 6' allows air to enter the can above the fluid precisely in the space where practically a vacuum forms between the bottom of the can and the fluid, when the can is tilted, i.e. in emptying position.

The quick emptying with fluid flow in the absence of turbulence or oscillations takes place in practice in the following way. Keeping the can in a substantially upright position, one tears away the pull tag on cover 2, then tilts the can in the usual way, so as to allow the emptying into a vessel, generally a glass, or also directly into the mouth of the user. At the same time, the second opening arranged on the bottom or the wall near said bottom is opened. Now, the atmospheric pressure, entering the bottom of the can, acts on the fluid, allowing its quick and regular outflow from the mouth of said can. According to the invention, the emptying of the can may also take place by utilizing opening 10 or 6' of the can. The two openings produced by the first and second tabs are preferably in diametrical opposition.

Obviously, in the practical realization, structurally and functionally equivalent changes may be brought to the invention as above described and illustrated by way of example, either in the shape and size of the can and in the type of opening of the distributing mouth (pull tag, screw or the like), and also in the type of devices suitable to create said second opening without exceeding the protection of this invention.

I claim:

1. A disposable metal beverage can having a cylindrical body with a circular top and an opposite circular bottom comprising:

a first easy-opening tab disposed on the circular top of the can for removing a first portion of small area of said circular top, for creating a first opening of small area;

a second easy-opening tab disposed on the circular bottom of the can for removing a second portion of small area of said circular bottom for creating a second opening of small area; and said second opening positioned on the bottom near the edge of said bottom in diametrical opposition to said first opening;

wherein said first tab is opened for distributing the beverage through the first opening by tilting the can to raise the bottom above the top to open said second tab without significant stresses on the can so that air enters the can above the beverage for rapid and regular emptying of the can directly into the mouth of the consumer while avoiding beverage splashing and turbulence within the beverage during pouring, said first and second portions being of such a small area that said first and second openings do not affect the mechanical resistance of the can.

* * * * *